US009004642B2

(12) United States Patent
Fernandez Del Rio et al.

(10) Patent No.: US 9,004,642 B2
(45) Date of Patent: Apr. 14, 2015

(54) APPARATUS AND METHOD FOR CONTROLLING A PRINTING DEVICE

(71) Applicant: Hewlett-Packard Development Company, L.P., Houston, TX (US)

(72) Inventors: Jaime Fernandez Del Rio, San Diego, CA (US); Jacint Humet Pous, Barcelona (ES); Eduardo Amela Conesa, Barcelona (ES); Marc Serra Vall, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 14 days.

(21) Appl. No.: 13/752,173

(22) Filed: Jan. 28, 2013

(65) Prior Publication Data

US 2014/0210887 A1 Jul. 31, 2014

(51) Int. Cl.
*B41J 2/07* (2006.01)
*B41J 2/21* (2006.01)

(52) U.S. Cl.
CPC . *B41J 2/07* (2013.01); *B41J 2/2114* (2013.01)

(58) Field of Classification Search
USPC ..... 347/9, 14, 15, 19, 20, 44, 45, 98, 40, 43
See application file for complete search history.

(56) References Cited

U.S. PATENT DOCUMENTS

| | | | | |
|---|---|---|---|---|
| 5,600,350 | A * | 2/1997 | Cobbs et al. | 347/19 |
| 5,796,414 | A * | 8/1998 | Sievert et al. | 347/19 |
| 6,371,609 | B1 * | 4/2002 | Oikawa | 347/40 |
| 6,412,935 | B1 | 7/2002 | Doumaux | |
| 6,443,568 | B1 | 9/2002 | Askeland et al. | |
| 6,685,297 | B2 * | 2/2004 | Butterfield et al. | 347/19 |
| 6,789,867 | B2 * | 9/2004 | Takahashi et al. | 347/12 |
| 7,926,908 | B2 * | 4/2011 | Mizutani | 347/43 |
| 2001/0038399 | A1 * | 11/2001 | Lund et al. | 347/19 |
| 2004/0263563 | A1 * | 12/2004 | Escobedo et al. | 347/40 |
| 2006/0158481 | A1 * | 7/2006 | Spevak et al. | 347/43 |
| 2011/0001779 | A1 | 1/2011 | Kida | |

OTHER PUBLICATIONS

WIPO WO 2013/056748A1 Published Apr. 25, 2013.*

* cited by examiner

*Primary Examiner* — Julian Huffman
*Assistant Examiner* — Sharon A Polk
(74) *Attorney, Agent, or Firm* — Hewlett-Packard Patent Department

(57) ABSTRACT

An apparatus and method for controlling a printing device are described. In examples, a printing device has a first printhead interface, a first printhead for use in applying a treatment fluid to a print medium and a second printhead interface, a second printhead for use in applying ink to the print medium. The first and second printhead interfaces are consecutively aligned along a common axis and each printhead has a plurality of nozzles that extend in a direction of relative movement of the print medium in relation to said printheads. An example apparatus then has a controller arranged to, when the printheads are installed, configure activation of nozzles of at least one of the first and second printheads in the direction of relative movement to spatially offset useable nozzles of the first printhead with respect to useable nozzles of the second printhead in said direction.

18 Claims, 15 Drawing Sheets

APPARATUS AND METHOD FOR CONTROLLING A PRINTING DEVICE

BACKGROUND

Printing devices such as inkjet printers may comprise one or more printheads for depositing ink onto a print medium. These printing devices may be used in a wide variety of applications, and may include computer printers, plotters, copiers, and facsimile machines. Often a printhead forms part of a removable printer pen or cartridge. In certain printing devices it may be desired to apply a treatment fluid, as well as ink, to a print medium. For example, a pre-treatment fluid may be "underprinted", i.e. deposited prior to depositing ink on a print medium, and/or a post-treatment fluid may be "overprinted", i.e. deposited after depositing ink on a print medium. The use of treatment fluid may improve one or more characteristics of a printed output, for example improve at least one of ink adhesion, durability, and ink absorption.

BRIEF DESCRIPTION OF THE DRAWINGS

Various features and advantages of the present disclosure will be apparent from the detailed description which follows, taken in conjunction with the accompanying drawings, which together illustrate, by way of example only, features of the present disclosure, and wherein.

DETAILED DESCRIPTION

In the following description, for purposes of explanation, numerous specific details are set forth in order to provide a thorough understanding of the present apparatus and method. It will be apparent, however, to one skilled in the art that the present apparatus and methods may be practiced without these specific details. Reference in the specification to "an example" or similar language means that a particular feature, structure, or characteristic described in connection with the example is included in at least that one example, but not necessarily in other examples.

Figure 1A:
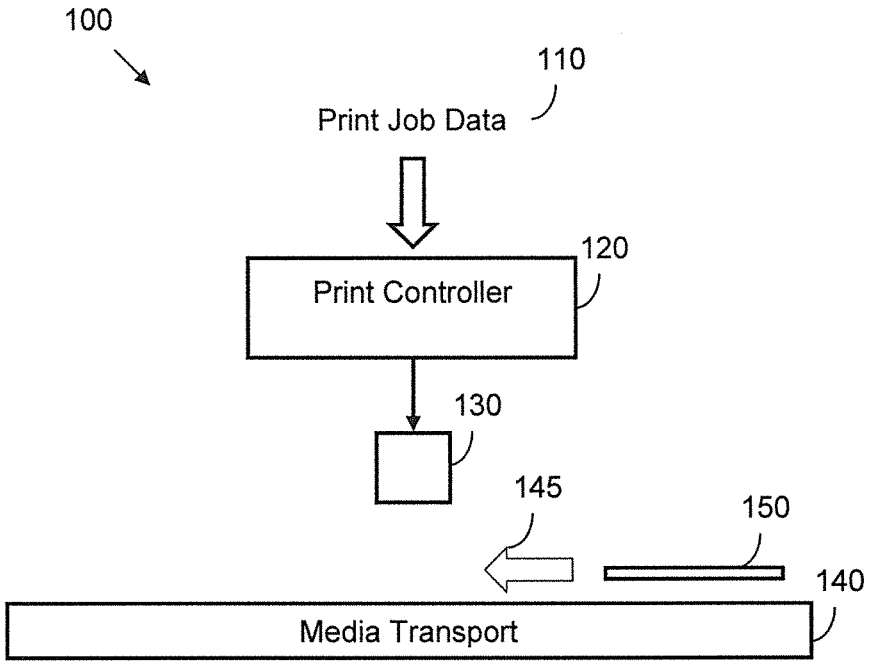
FIG. 1A is a schematic illustration showing a first view of a printing device according to an example.

An example of a printing device 100 is shown in FIG. 1A. FIG. 1A, as well as other Figures reference herein, is a schematic diagram, as such certain components have been omitted to facilitate a description of the example and actual implementations may vary in practice. In the printing system 100, print job data 110 is received by a print controller 120. The print job data 110 may comprise image and/or control data associated with a document to be printed, e.g. one or more data files representing an image with a width and a height that comprises a plurality of pixel values. The print job data 110 may be generated by a print workflow manager (not shown) on receipt of a new print job from a user of a computer system. It may comprise digital and/or analog data. The print controller 120 processes the print job data 110 and accordingly controls a printing arrangement 130. The printing arrangement 130 deposits one or more of ink and a treatment fluid onto a print medium 150. In the present example, the print medium 150 is carried under the printing arrangement 130 by a media transport 140. The printing arrangement 130 may be vertically and/or horizontally spaced from the print medium 150, depending on the implementation. A vertically-spaced arrangement is shown in FIG. 1A for ease of explanation. The media transport 140 moves the print medium 150 in direction 145 incrementally such that successive portions of an image may be printed. With reference to direction 145, "downstream" indicates in a direction of portions of the print medium that have had been the subject of printing and "upstream" indicates in a direction of portions of the print medium have yet to be printed upon.

Figure 1B:
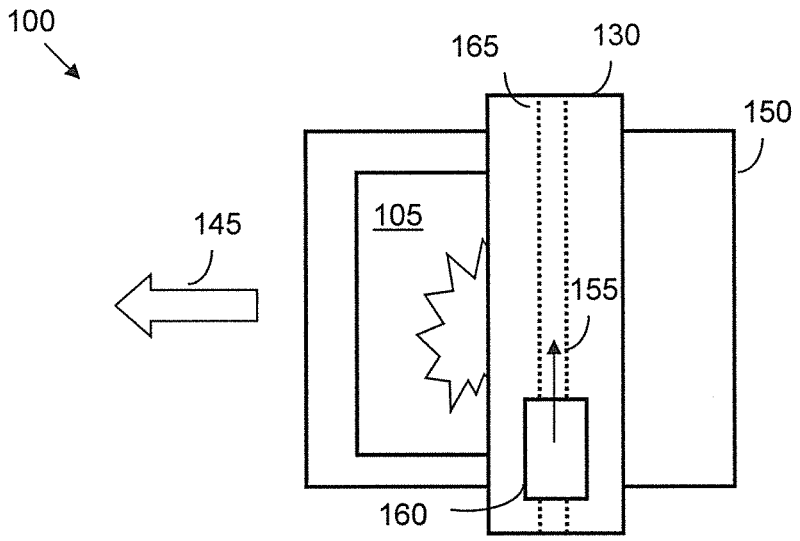
FIG. 1B is a schematic illustration showing a second view of a printing device according to an example.

As shown in FIG. 1B, in the present example, the print arrangement 130 comprises a moveable carriage 160 that moves across a width of the print medium 150 in direction 155. In this example, the width of the print medium 150 is aligned with a width of an image to be printed. In FIG. 1B the moveable carriage 160 is mounted on guides 165 that may comprise tracks or rails. In a printing operation the print medium 150 is incrementally moved beneath the printing arrangement 130. During its residence beneath the printing arrangement 130, the moveable carriage scans across the width of the print medium in direction 155 to deposit one or more swaths of ink and/or a treatment fluid. In the printing operation, a plurality of swaths are deposited with a relative movement of the print medium in relation to the printing arrangement 130 being effected between successive swaths. Over time, a plurality of swaths forms a printed image 105.

Figure 1C:
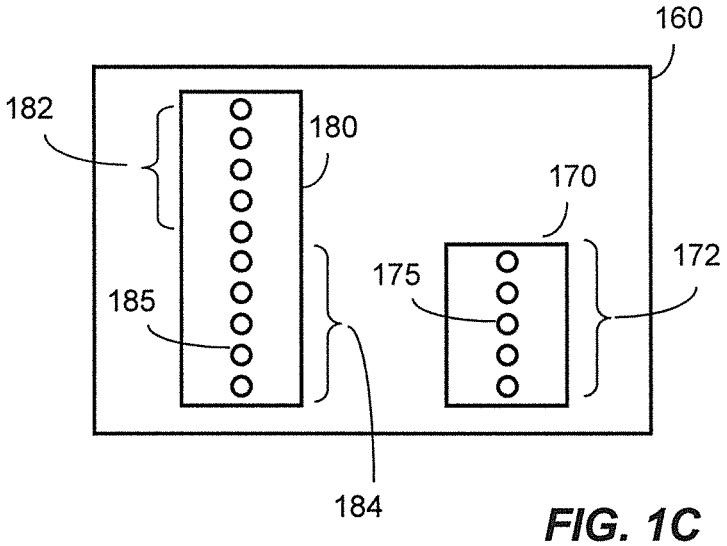
FIG. 1C is a schematic illustration showing a print carriage according to an example.

FIG. 1C shows a schematic example of the moveable carriage 160. In this example, the moveable carriage 160 holds two printheads. Each printhead may form part of a removable printer pen. A first printhead 170 comprises a first plurality of nozzles 175 for ejecting a treatment fluid. This first plurality of nozzles 175 or nozzle array has a first height 172, wherein the height of a printhead indicates the number of addressable nozzles that may be used for depositing a treatment fluid during the printing of an image. This is the case even if, for a printing operation involving a particular portion of an image, not all of the addressable nozzles are actually used. A second printhead 180 comprises a second plurality of nozzles 185 for ejecting ink. This second plurality of nozzles 175 or nozzle array has a second height comprising two portions: upper portion 182 and lower portion 184.

In the present example, each of printheads 170 and 180 has a plurality of independently addressable firing units coupled to respective nozzles 172, 182 and 184. Each firing unit may include an ink chamber connected to an ink source, which may be a common ink source, and to an appropriate ink outlet nozzle. A transducer within the chamber provides the impetus for expelling ink droplets through the nozzles. In a thermal ink-jet printer, the transducer may comprise a nozzle resister; in other ink-jet printers the transducer may comprise a piezoelectric element. In most cases, the ejection of ink by a transducer is controlled by a voltage signal, sometimes referred to as a firing signal. The firing signal may be generated by print controller 120 (sometimes also referred to as a print engine) based on image data associated with a print job, i.e. an image to be printed. Intermediate processing of data and/or a firing signal, other than that performed by print controller 120 is possible depending on the implementation. In the present example, a firing signal enables one or more of a treatment fluid and ink to be deposited on to the print medium 150 carried by the media transport 140.

Figure 1D:
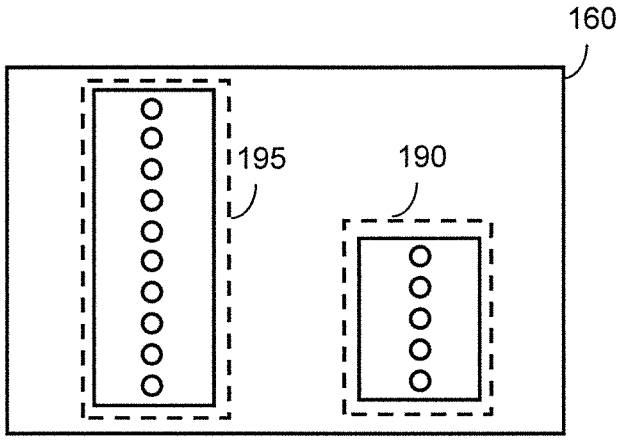
FIG. 1D is a schematic illustration showing interfaces for a first and second printhead in the print carriage of FIG. 1C.

FIG. 1D illustrates how one or more of printheads 170 and 180 may be removeably mounted in the moveable carriage 160. In the example of FIG. 1D, the first printhead 170 is removably mounted in a first interface 190 and the second printhead 180 is removably mounted in a second interface 195. In certain examples described herein, the first and second printhead interfaces are consecutively aligned along a common axis. For example, each printhead may form part of a replaceable printer pen or cartridge that may be mounted in said interfaces. The interfaces may comprise complementary fixings and/or other means for securely attaching a printer pen to the carriage.

An example of a printing operation that may be performed with the printing device 100 shown in FIGS. 1A to 1D will now be described with reference to FIGS. 2A to 2D. The printing operation described with reference to FIGS. 2A to 2D may take place under the control of print controller 120.

Figure 2A:
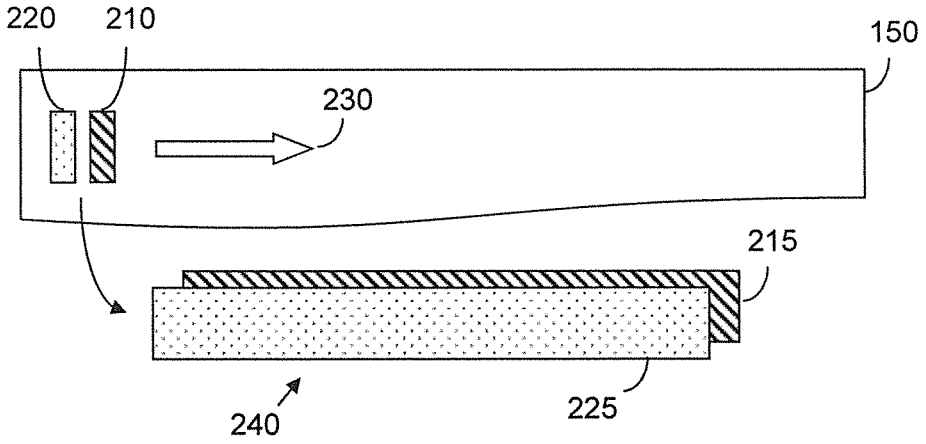
FIG. 2A is a schematic illustration showing the printing of a first swath in an example with aligned first and second printheads.

FIG. 2A shows a first printhead 210 and a portion of a second printhead 220 moveably mounted above a print medium 150. The two printheads 210 and 220 are arranged to move (or scan) across a width (or scan direction) of the print medium as depicted by arrow 230. The first printhead 210 is mounted in advance of the second printhead 220 in the scan direction 230. The first printhead 210 is arranged to deposit a pre-treatment fluid and the second printhead 220 is arranged to deposit ink. A pre-treatment fluid typically needs to be placed before, or at least simultaneously to, ink to be fixed to a print medium. In variations of the example of FIG. 2A one or more further printheads may be supplied, for example a printhead may be supplied to deposit ink of each of the colors: cyan, magenta, yellow, and black. The first printhead 210 and the second printhead 220 may comprise the first printhead 170 and the second printhead 180 of FIG. 1C.

During a first part of a printing operation as shown in FIG. 2A the first and second printheads 210 and 220 move in the scan direction 230 and respective deposit pre-treatment fluid and ink across the width of the print medium 150 (or at least a printable width of the print medium, which may be less than an actual width of the print medium in printing devices that have print margins). As the first printhead 210 is positioned in advance of the second printhead 220, i.e. is arranged before the second printhead 220 in the scan direction 230, a first swath of pre-treatment fluid 215 may be deposited (i.e. printed) under a first swath of ink 225. In the example of FIG. 2A the combination of swath 215 and swath 225 forms printed swath 240, such that swath 225 is printed on top of a layer of pre-treatment fluid.

Figure 2B:
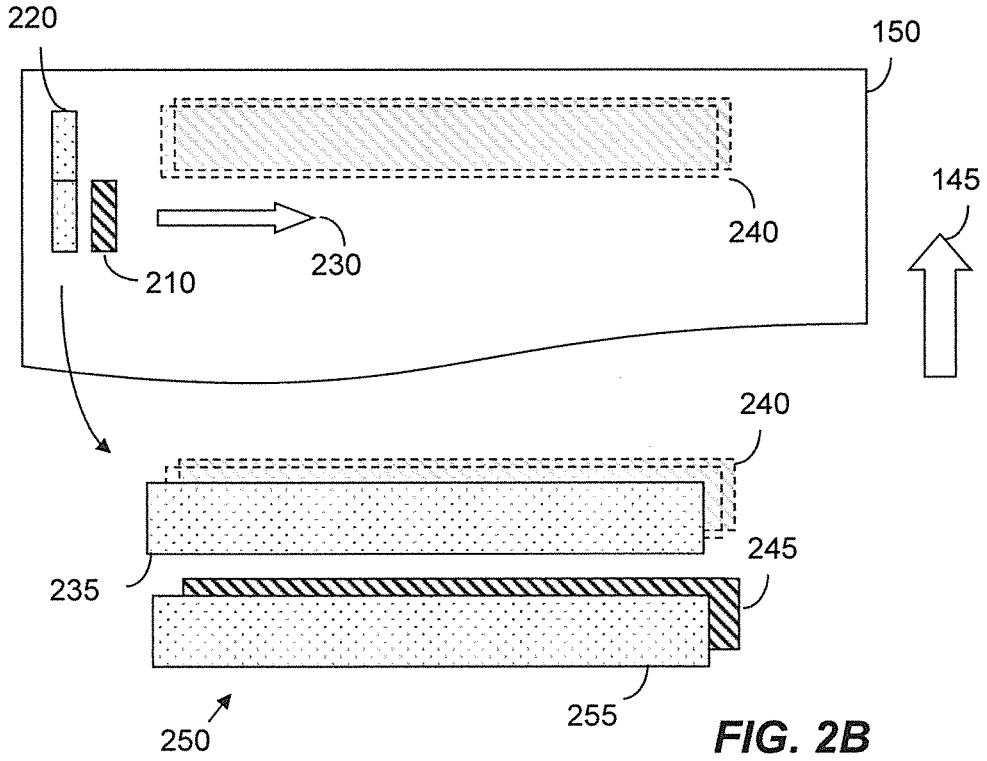
FIG. 2B is a schematic illustration showing the printing of a second swath in an example with aligned first and second printheads.

FIG. 2B shows a second part of a printing operation following an incremental movement of the print medium 150 in direction 145. Printed swath 240 is shown following deposit on the print medium 150. Printed swath 240 is moved downstream by the incremental movement and an unprinted region of the print medium is located underneath the printheads. In the present example, the print medium 150 is advanced in direction 145 by a distance substantially equal to the height of the first printhead 210, such that a successive swath deposited by the first printhead 210 is deposited adjacent to, and abutting, the printed swath 240. Following the incremental movement in direction 145 the first and second printheads 210 and 220 are moved in the scan direction 230 and respective deposit pre-treatment fluid and ink across the width of the print medium 150. In FIG. 2B a full height of the second printhead 220 is used to deposit ink. As such a first swath portion 235 with a height equal to the height of the swath of pre-treatment fluid 215 is deposited by the second printhead 220 over the printed swath 240. In the same movement of the first printhead 210 and the second printhead 220 over the print medium 150 in the scan direction 230, a second swath of pre-treatment fluid 245 is deposited under (i.e. in advance of on a common area of print medium) a second swath of ink 255. In the example of FIG. 2B the combination of swath 245 and swath 255 forms printed swath 250. After a second pass of the first and second printheads, previous printed swath 240 further comprises overprinted ink swath 235.

Figure 2C:
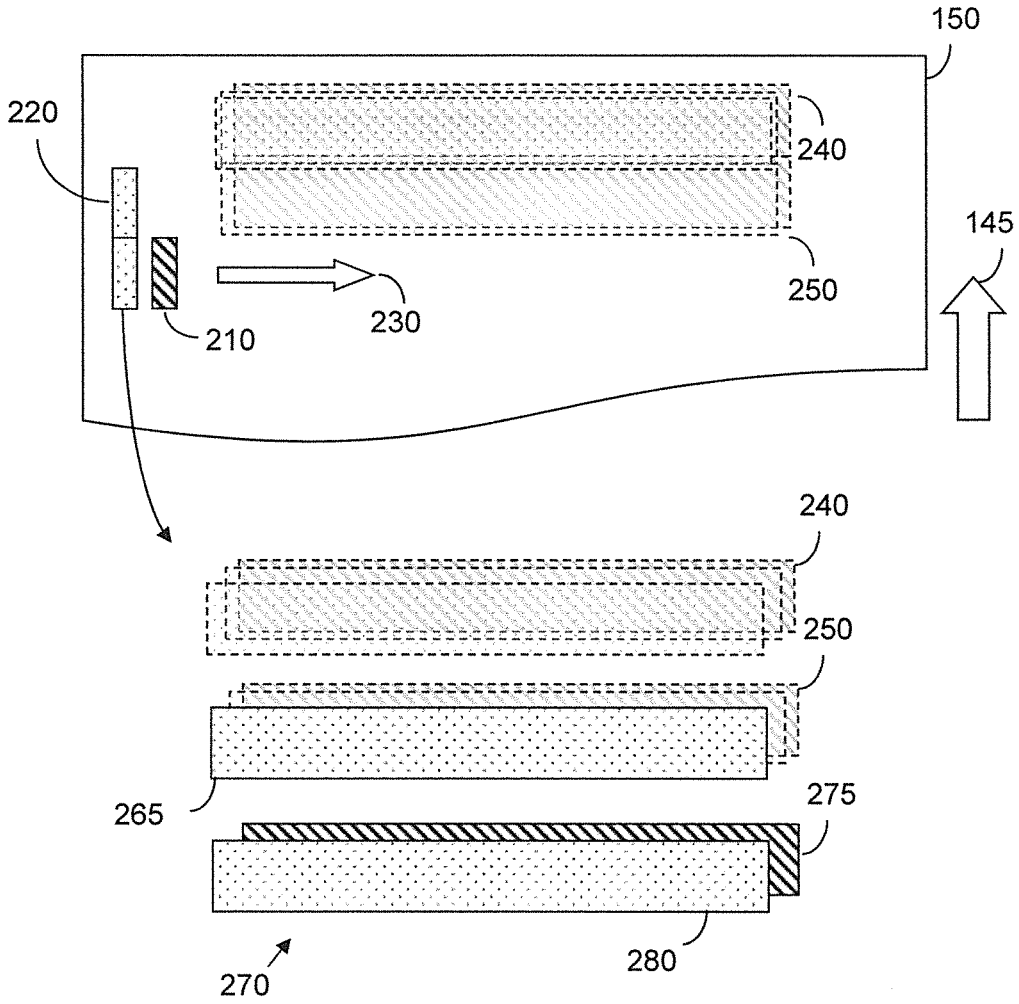
FIG. 2C is a schematic illustration showing the printing of a third swath in an example with aligned first and second printheads.

FIG. 2C shows a third part of a printing operation following a further incremental movement of the print medium 150 in direction 145. Printed swaths 240 and 250 are shown following deposit on the print medium 150, for example as described above with reference to FIGS. 2A and 2B. As described with reference to FIG. 2B, the print medium 150 is again advanced in direction 145 by a distance substantially equal to the height of the first printhead 210, such that a successive swath deposited by the first printhead 210 is deposited adjacent to, and abutting, the second printed swath 250. Following the incremental movement in direction 145 the first and second printheads 210 and 220 are moved in the scan direction 230 and respective deposit pre-treatment fluid and ink across the width of the print medium 150. In FIG. 2C, as with FIG. 2B, a full height of the second printhead 220 is used to deposit ink. As such a third swath portion 265 with a height equal to the height of a swath of pre-treatment fluid is deposited by the second printhead 220 over the printed swath 250. In the same movement of the first printhead 210 and the second printhead 220 over the print medium 150 in the scan direction 230, a third swath of pre-treatment fluid 275 is deposited under a third swath of ink 280. In the example of FIG. 2C the combination of swath 275 and swath 280 forms printed swath 270. After a second pass of the first and second printheads, previous printed swath 250 further comprises overprinted ink swath 265.

Figure 2D:
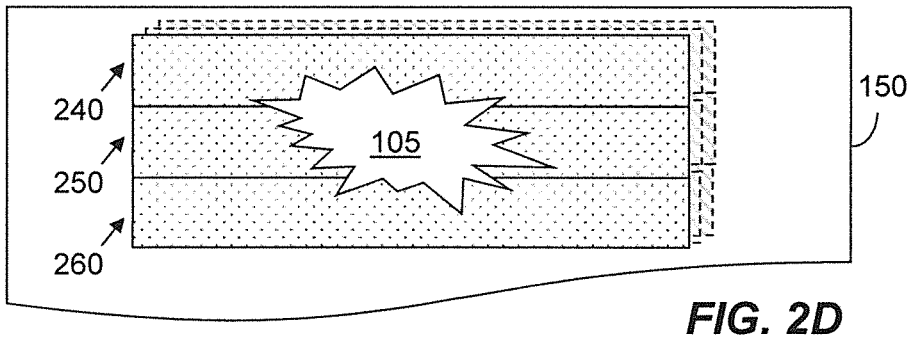
FIG. 2D is a schematic illustration showing a printed output on a print medium resulting from actions shown in FIGS. 2A to 2C.

FIG. 2D shows a simplified printed image 105 comprising the three swaths printed by the printing operations of FIGS. 2A, 2B and 2C. In most implementations a printed image comprises many more swaths than this simple example, additional swaths being printed in the manner shown in FIGS. 2B and 2C.

Figure 3A:
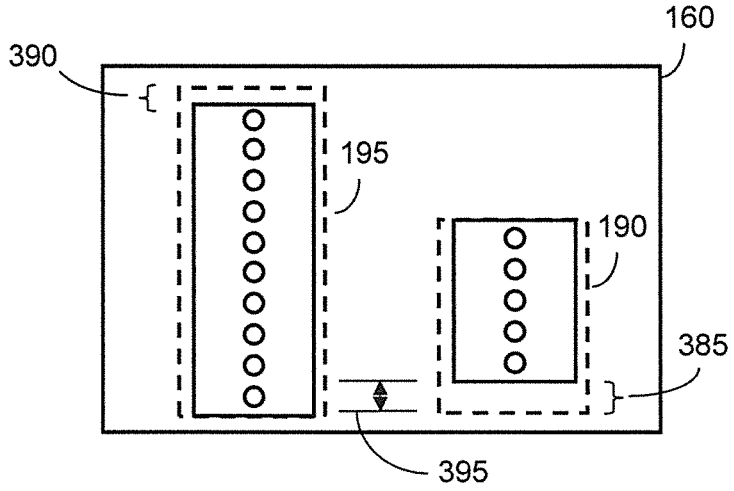
FIG. 3A is a schematic illustration showing misalignment of first and second printheads according to an example.

FIG. 3A shows a problem of misalignment of a first printhead that deposits a treatment fluid. In many cases it is not possible to ensure perfect alignment of a printhead for treatment fluid and at least one printhead for ink, for example it is not possible to ensure the alignment shown in FIGS. 1C and 1D. This problem may occur when one or more of a printer pen for ink and a printer pen for a treatment fluid are misaligned in one or more of fittings 190 and 195 as shown in FIG. 1D. For example, a printer pen for a treatment fluid may be misaligned, a printer pen for ink may be misaligned or both printer pens may be misaligned.

FIG. 3A shows how a printer pen for a treatment fluid comprising a first printhead is aligned at the top of fitting 190 and how a printer pen for ink comprising a second printhead is aligned at the bottom of fitting 195. This results in a misalignment 395 of the bottom nozzles that were previously aligned in FIG. 1D. This misalignment occurs in a direction parallel to the relative movement of the print medium, e.g. in the present examples, direction 145. This misalignment may occur because of one or more of: small differences in the sizes of successive printer pens, for example due to differences within a manufacturing tolerance; elastic and/or plastic deformation of at least one of the printer pens, fittings and mechanical fastenings; expansion and/or wear etc. Even though FIG. 3A shows misalignment of both printer pens in the fittings, misalignment may also occur with a single misaligned printer pen.

Figure 3B:
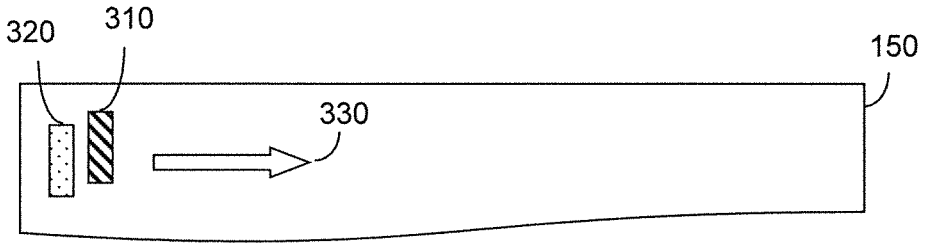
FIG. 3B is a schematic illustration showing how misaligned first and second printheads may be used to print a swath.

FIG. 3B shows a first printhead 310 and a portion of a second printhead 320 that are misaligned as shown in FIG. 3A. In a similar manner to FIG. 2A, the first printhead 310 and the second printhead 320 move across a print medium 150 in a scan direction 330.

Figure 3C:
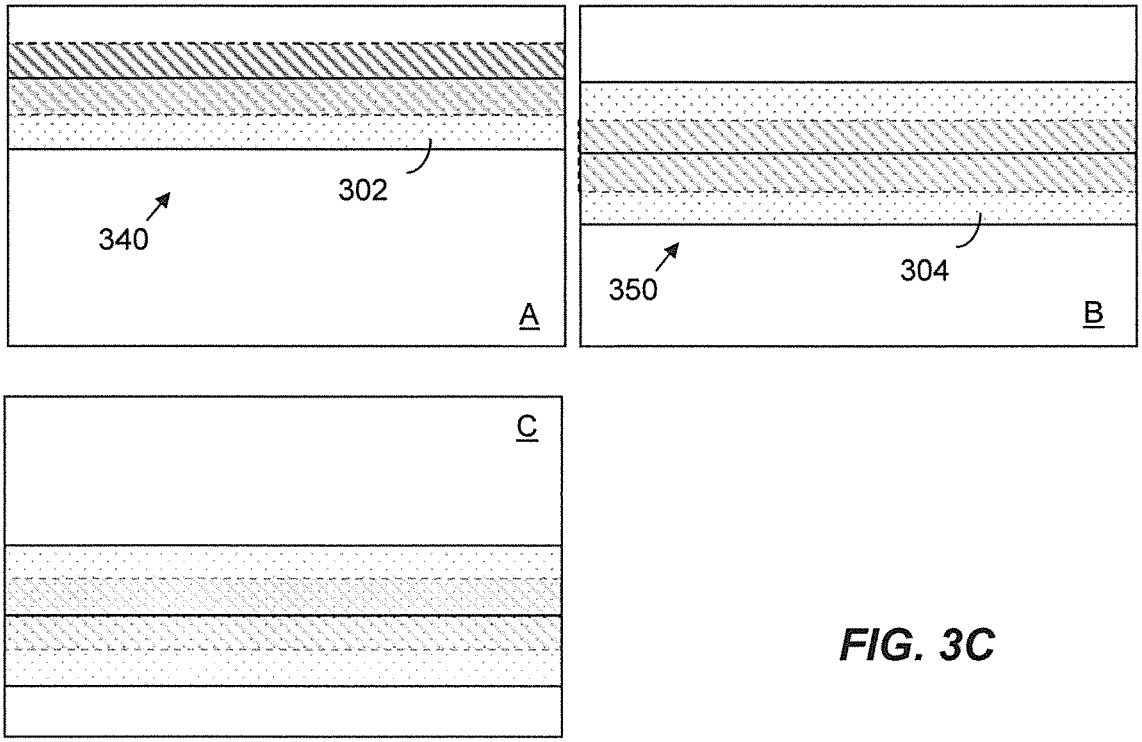
FIG. 3C is a schematic illustration showing, from above, print areas without a treatment fluid.
Figure 3D:
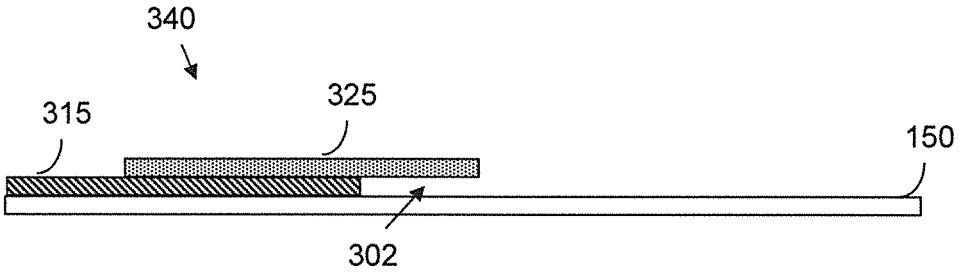
FIG. 3D is a schematic illustration showing, from the side, a print area from a first swath without a treatment fluid.
Figure 3E:
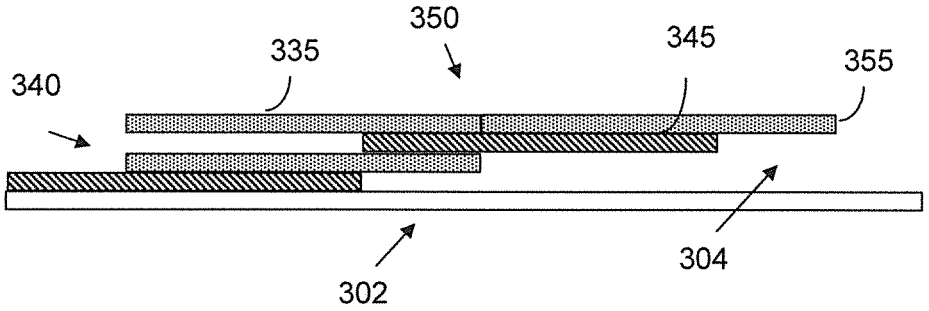
FIG. 3E is a schematic illustration showing, from the side, a print area from a second swath without a treatment fluid.

FIG. 3C shows a schematic illustration of a print medium from above as successive swaths are deposited with misaligned printheads. Panel A of FIG. 3C shows a printed swath 340 similar to swath 240 in FIG. 2A following the deposit of a pre-treatment fluid 315 and ink 325. A schematic side view is shown in FIG. 3D, wherein subsequent layers are shown schematically separated in a direction out of a print medium 150 for ease of explanation. As can be seen, there is a first area 302 of the swath 340 where ink is deposited with the second printhead 320 without an under-layer of pre-treatment fluid 315. First area 302 exists across the length of the printed swath 340. In first area 302, a portion of ink is deposited directly onto the print medium 105 without the under-layer of pre-treatment fluid 325. Such an area is generated for each subsequent swath. Panel B of FIG. 3C and FIG. 3E show the deposit of a second swath of pre-treatment fluid 345 that is adjacent to, and abuts, the first swath of pre-treatment fluid 315. A first swath portion 335 is deposited over ink swath 325 and a second swath portion 355 is deposited adjacent to, and abutting, the first swath portion 335. In this pass a second area 304 is generated where ink from the second swath portion 355 is deposited directly onto the print medium 150 without an under-layer of pre-treatment fluid 345. This continues in panel C of FIG. 3C, for example.

In areas 302 and 304, there is no pre-treatment fluid deposited on the print medium. If the pre-treatment fluid comprises a fixing solution then without this solution ink is free to coalesce and/or bleed until it is fixed in place by the deposit of pre-treatment fluid in a subsequent pass (e.g. see swath 345 in FIG. 3E, which is deposited on top of ink swath 325). Similar results apply for a post-treatment fluid, e.g. a fluid that needs to be deposited on-top of ink to improve fixing or drying. This may result in localized banding in a printed image due to coalescence or localized bleed. Localized banding or bleed may be visible as undesirable image artefacts in the printed image. For example, when using a pre-treatment fluid, alignment errors may produce thin areas at the first rows of every swath where ink is laid unfixed until the next pass of moveable carriage 160. It can also lead to higher ink-to-pre-treatment ratios, or variations in ink-to-pre-treatment ratios across a swath, which may cause banding or gloss bandings with particular forms of ink.

The undesirable effects of misalignment described above may be compounded by treatment fluids that are transparent or difficult to see. In these cases it may be difficult to visually determine whether there is any misalignment from a printed output. In such cases it is the appearance of printed artefacts that indicates that misalignment is present. These printed artefacts may be easily missed leading to a reduction in quality of supplied printed output.

In accordance with certain examples described herein, a printhead for a treatment fluid is logically offset from at least one printhead for ink. This addresses certain problems with misalignment of these printheads.

Figure 4A:
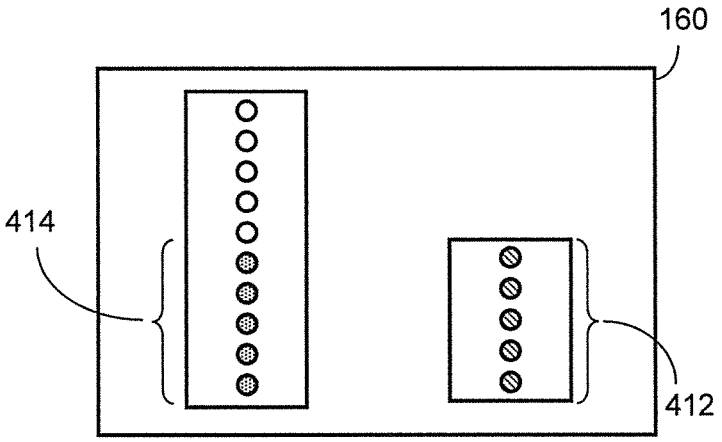
FIG. 4A is a schematic illustration showing a range of nozzles that may be activated in first and second printheads.

An example of a logical offset will now be described with reference to FIGS. 4A, 4B and 4C. These Figures schematically show a moveable carriage from above. For example, in use print media will approach the printheads from the bottom of these Figures. FIG. 4A shows a plurality of nozzles 412 forming part of a treatment fluid printhead and a plurality of nozzles 414 forming part of a lower portion of an ink printhead. For ease of explanation five nozzles for each printhead are shown in FIG. 4A. These five nozzles represent the nozzles that are potentially addressable to print a respective swath of treatment fluid or ink. For the second printhead, an upper portion of the printhead also comprises five nozzles. In one mode all ten nozzles of the second printhead are addressable to print ink. In practical implementations there may be many more nozzles (e.g. hundreds or thousands).

Figure 4B:
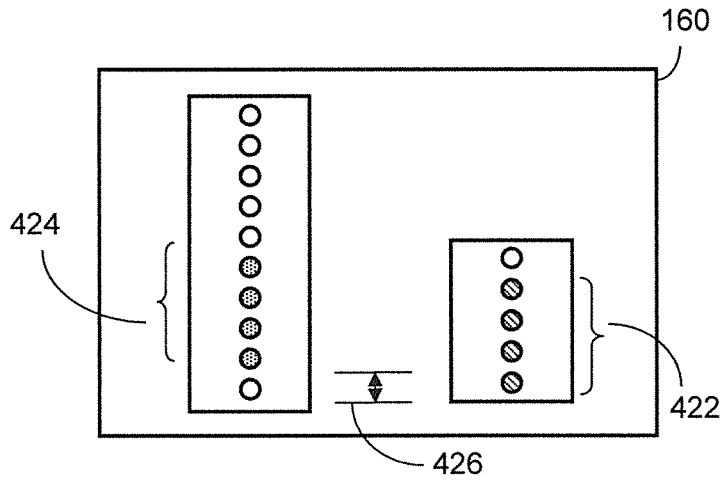
FIG. 4B is a schematic illustration showing a logical offset that may be applied to nozzles of the first and second printheads according to an example.
Figure 4C:
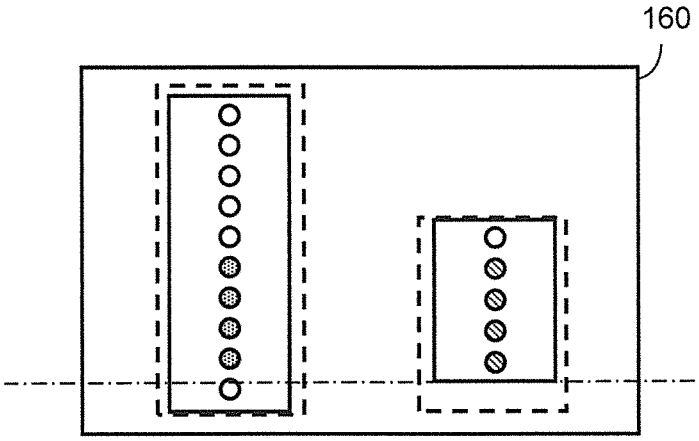
FIG. 4C is a schematic illustration showing a result of a logical offset for misaligned nozzles.

In FIG. 4B the printheads are controlled by the print controller 120 such that a subset of nozzles is useable for each printhead. For example, a subset of four nozzles 422 is useable to print treatment fluid with the first printhead and a subset of four nozzles 424 is useable to print ink with the second printhead. These two subsets produce a nozzle offset 426, wherein the useable nozzles of the first printhead are offset from the useable nozzles of the second printhead in a direction of print media movement. For example, in FIG. 4B, the lower four nozzles on the first printhead are used and the fifth nozzle on the first printhead is not used; whereas the second to fifth nozzles of the second printhead are used and the first nozzle on the second printhead is not used. This is a logical offset as it is provided by controlling useable nozzles rather than by physically aligning the printheads. These subsets of nozzles print a swath of treatment fluid and a swath of ink. In FIG. 4B if a moveable carriage 160 scans in direction 155 then a swath of pre-treatment fluid may be deposited followed by a swath of ink. The orientations of the printheads in the moveable carriage may be exchanged to print a swath of ink followed by a swath of post-treatment fluid. In each case each swath of ink is of a height determined by the number of useable nozzles of each printhead.

The logical offset described above ensures that the plurality of useable nozzles for the first printhead is ahead of, or at least aligned with, the plurality of useable nozzles for the second printhead. Here "ahead" is defined in relation to a print media advancement direction such as upstream in direction 145, i.e. when there is no physical misalignment of the first and second printheads, an unprinted section of a print medium will first come to a useable nozzle of the first printhead. When there is a maximum misalignment of the two printheads, such as that shown in FIG. 3A, FIG. 4C demonstrates how the nozzles are aligned.

Figure 4D:
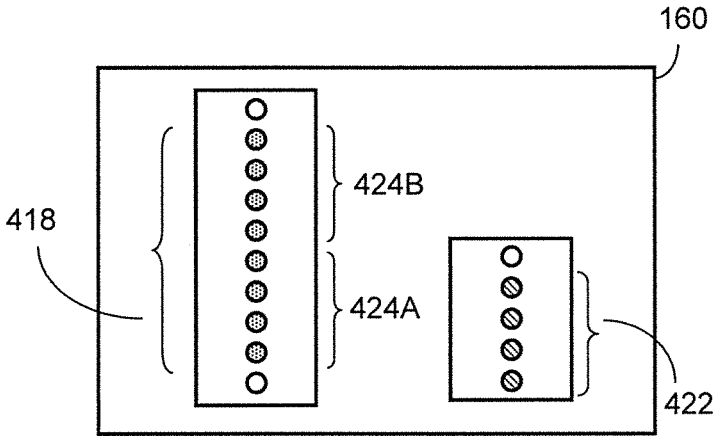
FIG. 4D is a schematic illustration showing a logical offset applied when both upper and lower portions of a second printhead are activated.

FIG. 4D shows how a logical offset may be applied to a lower portion 424A and an upper portion 424B of a second printhead. In this case the upper portion 424B also has four useable nozzles that are adjacent to the four useable nozzles of the lower portion 424A. Hence, there are eight nozzles available for the printing of ink from the second printhead, rather than the ten originally addressable nozzles.

Figure 4E:
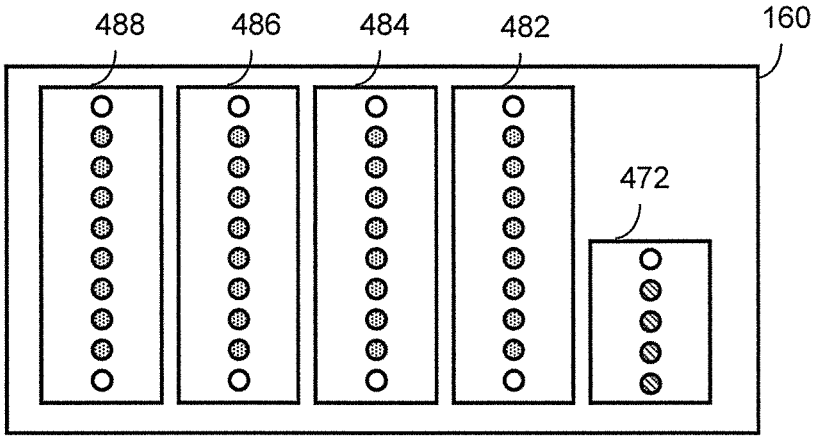
FIG. 4E is a schematic illustration showing a logical offset applied for a plurality of ink printheads.

FIG. 4E shows an example where a plurality of ink printheads is used. FIG. 4E shows a first printhead 472 for depositing a treatment fluid and second, third, fourth and fifth printheads 482 to 488 for depositing ink. As is shown in FIG. 4E, a logically offset may be applied for each printhead arranged to deposit ink.

FIGS. 5A to 5D demonstrate how one or more swaths of pre-treatment fluid and ink may be deposited on a print medium 150 using a logical offset, for example as described with regard to FIGS. 4A to 4D. These Figures may be compared to the comparative case shown in FIGS. 3D and 3E.

Figure 5A:
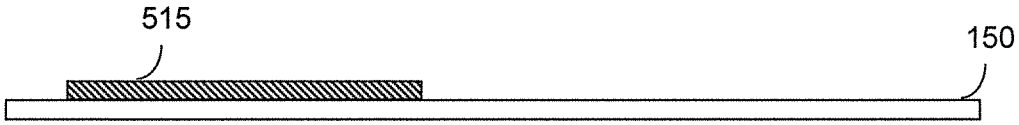
FIGS. 5A to 5D are schematic illustrations showing the deposit of a treatment fluid and ink in successive swaths when using a logical offset.
Figure 5B:
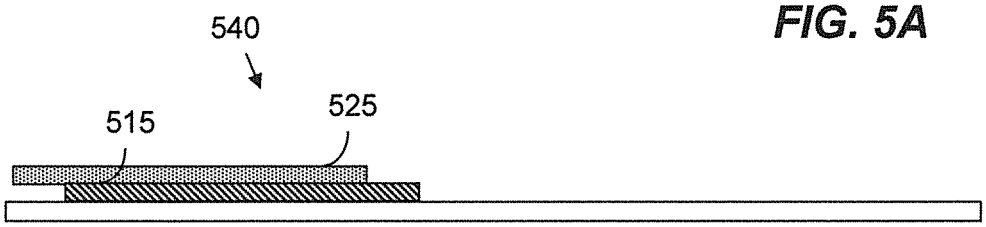

During a first part of a printing operation, first and second printheads are moved in a scan direction (similar to scan direction 230) and respectively deposit pre-treatment fluid 515 and ink 525 across the width of the print medium 150. If the arrangement of FIG. 4A is used, the first printhead is positioned in advance of the second printhead, i.e. is arranged before the second printhead in the scan direction. This results in a first swath of pre-treatment fluid 515 that is applied as shown in FIG. 5A before the deposition of a first swath of ink 525 as shown in FIG. 5B. In the example of FIG. 5B the combination of swath 515 and swath 525 forms printed swath 540, such that ink swath 525 is printed on top of a layer of pre-treatment fluid. As can be seen by comparing FIG. 3D and FIG. 5B, with the logical offset the pre-treatment swath now leads the ink swath in a direction of print media relative movement.

Figure 5C:
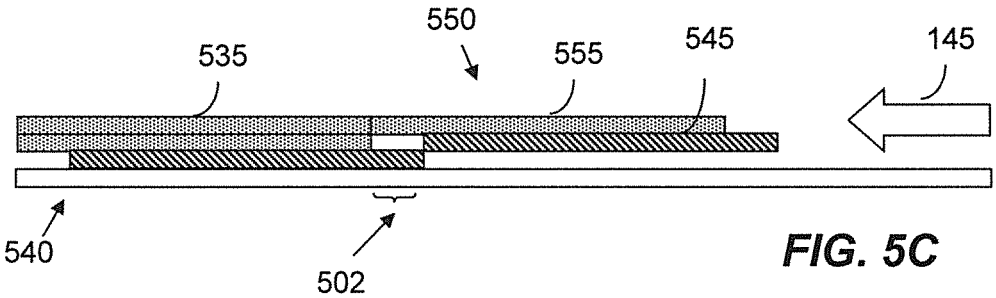

FIG. 5C shows a second part of a printing operation following an incremental movement of the print medium 150 downstream in direction 145. This movement may be generated by one or more of movement of the print medium and movement of the first and second printheads, depending on the implementation. Printed swath 540 is shown following deposit on the print medium 150. In the present example, the print medium 150 is advanced in direction 145 by a distance substantially equal to the distance between nozzles at the extremity of the printhead, e.g. a 'height' of the first printhead in the plane shown in FIGS. 4A to 4E, such that a successive swath deposited by the first printhead is deposited adjacent to, and abutting, the printed swath 540. If a swath of the first printhead is generated using the four useable nozzles of FIG. 4B, then printed swath 540 will be four units in height.

In this example, following the incremental movement in direction 145, the first and second printheads are moved in the scan direction and respective deposit pre-treatment fluid and ink across the width of the print medium 150. In FIG. 5C a full height of the second printhead is used to deposit ink. As such a first swath portion 535 with a height equal to the height of the swath of pre-treatment fluid 515 (or the height of the ink swath 525) is deposited by the second printhead over the printed swath 540. In the same movement of the first printhead and the second printhead over the print medium 150 in the scan direction, a second swath of pre-treatment fluid 545 is deposited under (i.e. in advance of on a common area of print medium) a second swath of ink 555. In the example of FIG. 5C the combination of swath 545 and swath 555 forms printed swath 550. After a second pass of the first and second printheads, previous printed swath 540 further comprises overprinted ink swath 535.

Figure 5D:
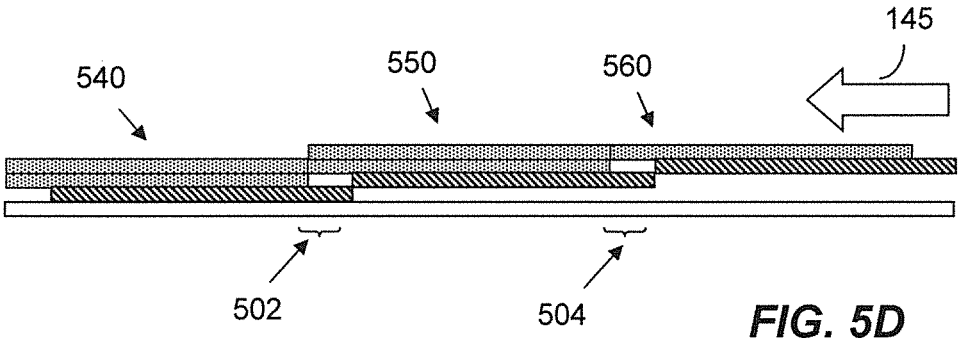

As can be seen by comparing FIG. 5C and FIGS. 3D and 3E, the logical offset applied to the nozzles avoids an area of ink being printed directly onto the print medium 150 without an underlying pre-treatment layer. For example, FIG. 5C shows a print area 502 similar to print area 302 in FIGS. 3D and 3E. However, in comparison with print area 302, print area 502 in FIG. 5C has a first layer of pre-treatment fluid, which is deposited as part of pre-treatment swath 515 before ink is deposited as part of ink swath 555. Similarly, FIG. 5D shows how a further print area 504, which is comparable to print area 304 in FIG. 3E, has an underlayer of pre-treatment fluid deposited as part of swath 545 before ink is deposited as part of a second swath portion of printed swath 560. As such by ensuring that any misalignment of deposited swaths occurs as shown in FIGS. 5C and 5C, the application of a logical offset avoids the deposit of ink on areas of a print medium that have not been treated with a treatment fluid.

Figure 6:
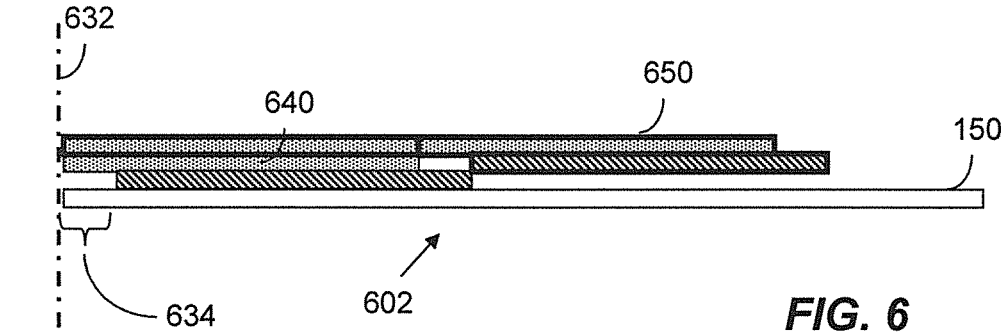
FIG. 6 is a schematic illustration showing a print area without a treatment fluid according to an example.

When a logical offset is applied as described above, ink for one or more initial pixel lines of an image may be deposited without treatment fluid. Whereas comparative methods without the logical offset repeat this band of missing treatment fluid for each swath (for example, see FIG. 3E), the presently described methods produce this result for the first swath of an image to be printed. For example, FIG. 6 shows a first printed swath 640 and a second printed swath 650. These are respectively comparable with printed swaths 540 and 550 in FIGS. 5A to 5D. In FIG. 6 the start of a printed image is indicated by vertical line 632. In this case print area 634 at the beginning of the printed image has two layers of ink that are deposited as part of printed swaths 640 and 650. However, printed area 634 does not have a layer of under-printed pre-treatment fluid. This may be compared to print area 602 that does have a layer of under-printed pre-treatment fluid.

In certain cases the printing of ink without an underlayer of pre-treatment fluid is acceptable. This may be because one or more initial pixel lines comprise part of an image margin or border or it may be because it is harder to distinguish a single feature at the start of a printed image as compared to many artefacts located throughout an image made up of many swaths. In a variation of certain examples described herein, however, print area 634 may be avoided by adding an extra pass of the moveable carriage to the beginning of a printed image, before normal printing using a full height of a second printhead commences. This is shown in FIGS. 7A and 7B.

Figure 7A:
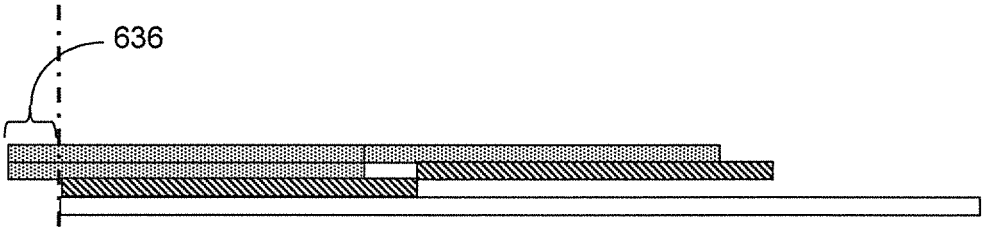
FIGS. 7A and 7B are schematic illustrations showing the deposit of a treatment fluid and ink in successive swaths according to an example.
Figure 7B:
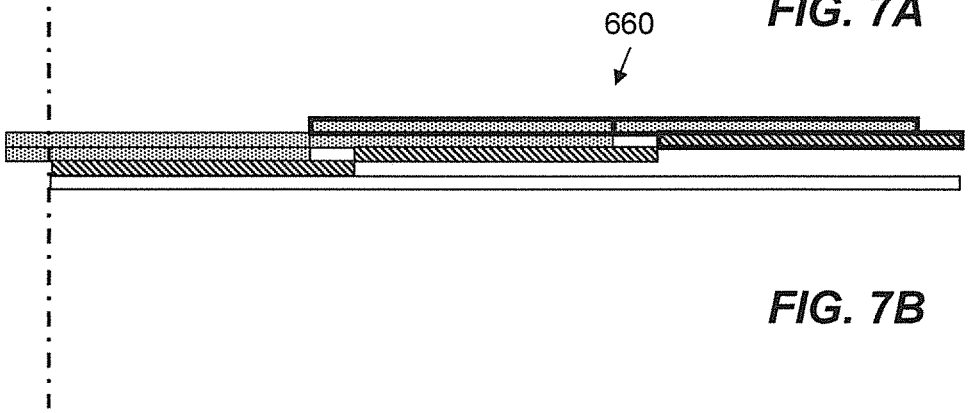

In FIG. 7A the start of a printed image is configured to occur at the start of the first swath of pre-treatment fluid deposited by a first printhead. In FIG. 7A this is marked by vertical line 632. As such no image is printed in print area 636. As shown in FIG. 7B the first full height swath printed by the second printhead, i.e. comprising both lower and upper portions, arises later in the print. This may be achieved by configuring print controller 120. For example, the mapping of print swaths to image data may be shifted in a direction corresponding to direction 145 such that one or more initial swath portions printed by a second printhead have a height less that a normal swath portion height. In the schematic example of FIG. 4B, this may be achieved by using three nozzles to print image data in a first swath printed by lower nozzles of the second printhead, similar to swath 525, and using three nozzles to print image data in a first swath portion, similar to portion 535. Subsequent swath portions, starting with those forming part of printed swath 660 are then printed with four useable nozzles, as for example shown in FIG. 4D. In an alternative implementation, an extra portion of white-space and/or null-data may be added to image data such that no ink is deposited in print area 636.

Figure 8:
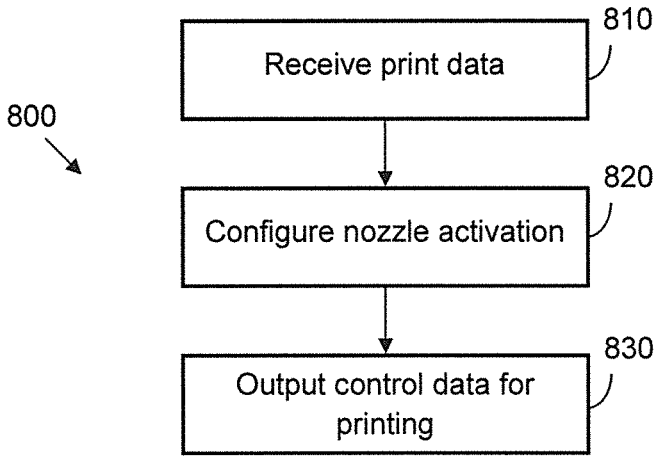
FIG. 8 is a flow diagram showing a first method for controlling the application of a treatment fluid and ink to a print medium according to an example.

An example of a method for controlling the application of a treatment fluid and ink to a print medium will now be described with reference to FIG. 8. This method may be applied using the apparatus shown in FIG. 1A to 1D. At block 810 print data is received. Print data may comprise an image or document to be printed, for example as received from a computing device. At block 820, nozzle activation for one or more printheads used to print an image is configured. The one or more printheads may comprise a first printhead for depositing a treatment fluid and a second printhead for depositing ink. Each printhead may form part of a printer pen. Each printhead comprises a plurality of nozzles having a height in a direction of relative movement of a print medium in relation to said printheads. For printer pens replaceably mounted in a moveable carriage arranged to move in a scan direction across the width of the print medium, a height may be defined as a number of nozzles in a direction perpendicular to the scan direction. The configuration of nozzle activation at block 820 is performed to spatially offset useable nozzles of the first printhead with respect to useable nozzles of the second printhead. This may be achieved by controlling which nozzles in one or more of the printheads are available to receive print data to print a swath or swath portion of a respective one or more of treatment fluid and ink. For example, image data may be decomposed into a plurality of swaths of a set pixel height, a pixel corresponding to a drop of ink and/or treatment fluid ejected from a nozzle of a printhead. The pixel height of one or more of the plurality of swaths may be set to be less that a number of available nozzles on one or more of the printheads. Differently aligned sets of nozzles on each printhead may thus be selectively activated to print a respective swath of treatment fluid and ink. This may be performed as described above with reference to FIGS. 4A to 4D and 5A to 5D. In one case, nozzle activations may be configured for a plurality of swaths as part of a pre-print process; in other cases activations may be configured on a per-swath basis during a printing operation. A combination of these control methods may also be used. In a case when pre-treatment fluid is used the fluid may be deposited before ink. In a case when post-treatment fluid is used the fluid may be deposited after ink. The first and second printheads may be consecutively aligned in the scan direction. The order in which the printheads are arranged may depend on whether a pre- or post-treatment fluid is being used. In certain cases both a pre- and post-treatment fluid may be used, with a dedicated printhead for each particular fluid. At block 830, control data to eject ink and/or pre-treatment fluid from nozzles of each printhead is generated and sent to nozzle transducers.

Figure 9:
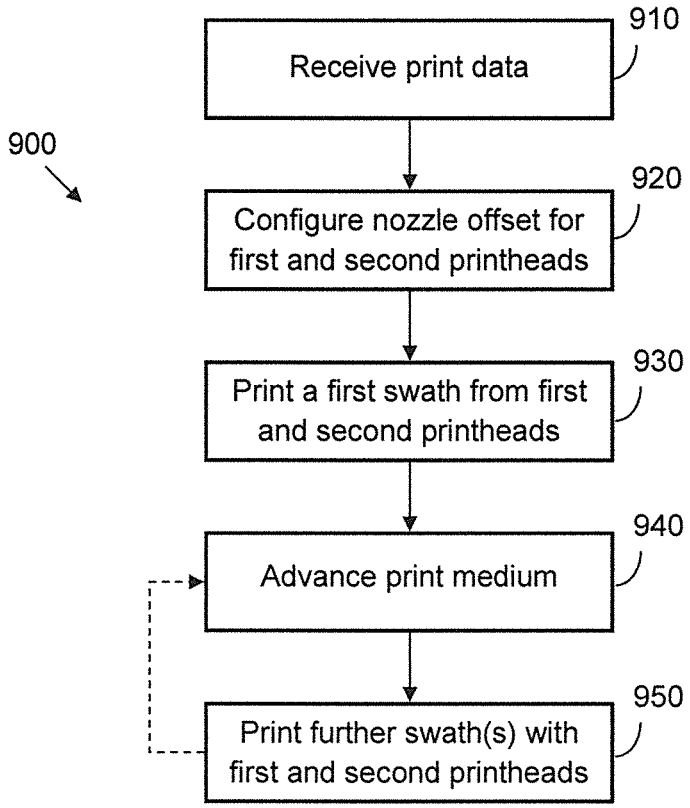
FIG. 9 is a flow diagram showing a second method for controlling the application of a treatment fluid and ink to a print medium according to an example.

Another example of a method for controlling the application of a treatment fluid and ink to a print medium is shown in the flow diagram of FIG. 9. At block 910, print data is received, in a similar manner to that described above. At block 920, a nozzle offset is configured for a first printhead and a second printhead, the first printhead being arranged to deposit a treatment fluid and the second printhead being arranged to deposit ink. One or more further ink printheads may also be configured. A nozzle offset may be configured by print controller 120. In this example, a nozzle offset is configured by setting a subset of addressable nozzles for one or more of the printheads as useable nozzles for a swath, and setting the height of a swath to be equal to the height of the set of useable nozzles. The subsets of useable nozzles for each printhead are then selected such that said subsets are offset from each other in a direction perpendicular to a swath width, which may coincide to a media transport direction. An example of an offset is shown in FIGS. 4B and 4D. For cases where a second printhead is larger than a first printhead, a portion of the second printhead may have a set of useable nozzles that correspond to a height of a subset of useable nozzles of the first printhead.

In cases with a second printhead that has a height equal to a multiple of a height of a first printhead then a first swath is printed at block 930 with a portion of the nozzles of the second printhead that correspond to the number of nozzles used by the first printhead. Nozzle activation is controlled according to the nozzle activation pattern determined in block 920. In cases such as that shown in FIGS. 7A and 7B the number of nozzles used in one or more initial passes may be less than the number of useable nozzles for the first printhead. At block 940 a print medium is incrementally advanced, for example by a media transport such as 150 shown in FIG. 1A. At block 950, a further swath is printed by the first and second printheads. At this stage a full height of the second printhead may be used, such that lower and upper swath portions are printed, the upper swath portion being deposited over ink previously deposited at block 930. Blocks 940 and 950 may then be repeated a plurality of times to print an image that has been decomposed into a plurality of swaths.

Certain examples that offset treatment fluid deposited by a treatment fluid pen and ink deposited by at least one ink pen may have one or more effects. One effect is a high robustness to printer pen or printhead misalignments; even if printer pens or printheads are physically misaligned in their fittings this does not result in undesirable artefacts throughout a printed image. Another effect is that the solution can be easily implemented with existing printing devices by changing the control of the printing process. In many practical implementations a full height of a printhead may comprise hundreds if not thousands of nozzles, wherein a nozzle offset may comprise one or a few shifted nozzles. This may correspond to an offset of a few fractions of a millimeter in certain printing devices. As such a logical offset can be applied with a negligible effect on pen or printhead height and printer throughput. Having a logical offset avoids the need for physical staggering of printer pens or printheads, which may have unintended detrimental effects on printed output. A logical offset applied by a printer controller can be configured to be larger than a maximum potential misalignment, such as is shown in FIG. 3A. Another effect is that the offset may be easily modified over time. For example, if a new design of printer pen is released that has improved fixings, the logical offset may be reduced to correspond to a reduction in a maximum potential misalignment. Alternatively, a logical offset may be increased with use, reflecting possible plastic deformation in physical components that occurs over time.

Certain examples described herein reduce or avoid the need to ensure perfect alignment of a treatment fluid printhead and one or more ink printheads. Perfect alignment may be desired but it may be rarely achieved in practical printing systems; as such printing systems that require perfect alignment are not robust, e.g. small errors can produce undesirable print artefacts. Certain examples described herein may appear somewhat counter-intuitive; if said printheads are perfectly aligned a treatment fluid will be laid on a print medium ahead of ink. However, as shown in FIGS. 5C and 5D, in this case treatment fluid is still laid in a required location for a printed image such that print areas without treatment fluid are avoided. If the treatment fluid is a pre-treatment fluid that is used to fix ink to a print medium then certain examples described herein prevent issues with unfixed ink and/or variations in ink to pre-treatment fluid ratios.

Certain examples described herein reduce or avoid the need to physically stagger a treatment fluid printhead and one or more ink printheads. A physical staggering of printheads requires a moveable carriage with an increased height, which in turn results in one or more of a larger print arrangement 130, less space within a printing device and a larger printing device.

Certain examples described herein reduce or avoid, when a pre-treatment fluid is laid down at the same time as ink and at least a pre-treatment pen is misaligned, several rows of ink being printed without any pre-treatment fluid in the first Pass of every swath, e.g. avoid print areas 302 and 304 as shown in FIG. 3E.

At least some aspects of the examples described herein with reference to the drawings may be implemented using computer processes operating in processing systems or processors. For example, these processing systems or processors may implement print controller 120. These aspects may also be extended to computer programs, particularly computer programs on or in a carrier, adapted for putting the aspects into practice. The program may be in the form of non-transitory source code, object code, a code intermediate source and object code such as in partially compiled form, or in any other non-transitory form suitable for use in the implementation of processes according to the invention. The carrier may be any entity or device capable of carrying the program. For example, the carrier may comprise a storage medium, such as a solid-state drive (SSD) or other semiconductor-based RAM; a ROM, for example a CD ROM or a semiconductor ROM; a magnetic recording medium, for example a floppy disk or hard disk; optical memory devices in general; etc.

Similarly, it will be understood that any controller referred to herein may in practice be provided by a single chip or integrated circuit or plural chips or integrated circuits, optionally provided as a chipset, an application-specific integrated circuit (ASIC), field-programmable gate array (FPGA), etc. For example, this may apply to all or part of the print controller 120 or other printer control circuitry. The chip or chips may comprise circuitry (as well as possibly firmware) for embodying at least a data processor or processors as described above, which are configurable so as to operate in accordance with the described examples. In this regard, the described examples may be implemented at least in part by computer software stored in (non-transitory) memory and executable by the processor, or by hardware, or by a combination of tangibly stored software and hardware (and tangibly stored firmware).

The preceding description has been presented only to illustrate and describe examples of the principles described. Reference is made to first and second components for ease of explanation; the actual order of components may vary according to a particular implementation. Examples described herein deposit two or more layers of ink on a print medium; however, the methods and apparatus described herein may be applied to printing devices that deposit one layer of ink. The methods and apparatus described herein may also be adapted to apply for the deposit of pre-treatment fluid, ink and post-treatment fluid, such that useable nozzles of one or more respective printheads are offset in a direction perpendicular to a scan direction of the printheads. Although the term "ink" has been used, this may encompass other printing fluids. In certain Figures similar sets of reference numerals have been used to ease comparison of similar and/or comparative features. Respective heights or nozzle extremity distances of the two printheads and/or nozzle arrays may vary in certain implementations while maintaining a logical nozzle offset. Certain examples reflect circumstances wherein printheads are installed, for use, in a printing device. A controller as described herein may also form part of a printing device that does not comprise printheads, for example as may be the case during manufacture, sale or repair. This description is not intended to be exhaustive or to limit these principles to any precise form disclosed. Many modifications and variations are possible in light of the above teaching.

What is claimed is:

1. An apparatus for controlling a printing device, the printing device comprising a first printhead interface receiving a first printhead and a second printhead interface receiving a second printhead, the first and second printhead interfaces being consecutively aligned along a common axis, each of the first printhead and the second printhead comprising a respective plurality of nozzles extending in a direction of relative movement of a print medium with respect to said first and second printheads, the apparatus comprising:

a processor:

a memory on which is stored machine readable instructions that when executed by the processor cause the processor to:

logically offset a bottom-most useable nozzle of the plurality of nozzles in one of the first and second printheads to be a nozzle other than the bottom-most nozzle in the first or second printhead to compensate for a misalignment between the bottom-most nozzle in the first printhead and the bottom-most nozzle in the second printhead and cause a bottom-most useable nozzle in the first printhead to be aligned with a bottom-most useable nozzle in the second printhead in a direction perpendicular to the direction of relative movement, and wherein the plurality of nozzles of the first printhead extend a first distance in the direction of relative movement and the plurality of nozzles of the second printhead extend a second distance in the direction of relative movement, wherein the second distance is greater than the first distance.

2. The apparatus according to claim 1, wherein the first printhead is for use in applying a treatment fluid to the print medium and the second printhead for use in applying ink to the print medium.

3. The apparatus according to claim 2, wherein the first and second printheads are mountable in a moveable carriage, wherein the moveable carriage is to be scanned across a width of the print medium to print a swath of an image, and wherein the machine readable instructions are further to cause the processor to control the application of the treatment fluid from the plurality of nozzles of the first printhead and the application of ink from the plurality of nozzles of the second printhead to print at least one swath of the image.

4. The apparatus according to claim 3, wherein the machine readable instructions are further to cause the processor to control the application of ink for one or more initial swaths of an image using a plurality of nozzles of the second printhead that extend a distance less than a distance of a plurality of nozzles usable for one or more subsequent swaths of the image, the machine readable instructions being further to cause the processor to control the application of the treatment fluid for one or more initial swaths of the image using a plurality of nozzles that are also used for application of ink in said one or more subsequent swaths.

5. The apparatus according to claim 3, wherein the first and second printheads form part of a respective removable first and second printer pen.

6. The apparatus according to claim 3, wherein the print medium is moved by a media transport of the printing device in a direction perpendicular to a scan axis of the moveable carriage.

7. The apparatus according to claim 2, wherein the treatment fluid is one of a pre-treatment fluid and a post-treatment fluid.

8. The apparatus according to claim 1, wherein the printing device comprises one or more further printhead interfaces for receiving one or more further printheads, said one or more further printheads for use in applying ink to the print medium and the machine readable instructions are further to cause the processor to, when the one or more further printheads are installed in the printing device, control activation of nozzles of at least one of the first, second and one or more further printheads in the direction of relative movement to spatially offset useable nozzles of the first printhead with respect to useable nozzles of the second and one or more further printheads in said direction of relative movement.

9. The apparatus according to claim 1, wherein the machine readable instructions are further to cause the processor to receive data for at least one of the first and second printheads and to output data for controlling at least one of the first and second printheads.

10. The apparatus according to claim 1, wherein the printing device is an inkjet printer.

11. A method for controlling a printing device, the printing device comprising a first printhead interface receiving a first printhead and a second printhead interface receiving a second printhead, the first and second printhead interfaces being consecutively aligned along a common axis, each of the first printhead and the second printhead comprising a respective plurality of nozzles extending in a direction of relative movement of a print medium with respect to said first and second printheads, the method comprising:

controlling nozzle activation for at least one of the first and second printheads such that a bottom-most useable nozzle of the plurality of nozzles in one of the first and second printheads is logically offset to be a nozzle other than the bottom-most nozzle in the first or second printhead to compensate for a misalignment between the bottom-most nozzle in the first printhead and the bottom-most nozzle in the second printhead and cause a bottom-most useable nozzle in the first printhead to be aligned with a bottom-most useable nozzle in the second printhead in a direction perpendicular to the direction of relative movement, wherein controlling the nozzle activation comprises:

printing one or more initial swaths of an image using a first plurality of nozzles of the second printhead; and printing one or more subsequent swaths of an image using a second plurality of nozzles of the second printhead, the first plurality of nozzles being less than the second plurality of nozzles.

12. The method according to claim 11, wherein the first printhead includes a first plurality of nozzles extending a first distance in the direction of relative movement and the second printhead includes a second plurality of nozzles extending a second distance in the direction of relative movement, and wherein the second distance is greater than the first distance.

13. The method according to claim 11, comprising:

printing a swath of an image using the first and second printheads.

14. The method according to claim 13, wherein the printing device comprises a moveable carriage within which the first and second printheads are mountable, the first printhead being statically mountable before the second printhead in a direction of movement of the moveable carriage, and wherein printing a swath of an image using the first and second printheads comprises:

depositing treatment fluid from the first printhead; and depositing ink from the second printhead, said depositing of treatment fluid and ink occurring as the moveable carriage scans across a width of the print medium.

15. The method according to claim 14, wherein at least one of the first and second printheads is removeably mountable within the moveable carriage.

16. The method according to claim 14, wherein the treatment fluid is one of a pre-treatment fluid and a post-treatment fluid.

17. The method according to claim 11, wherein the printing device is an inkjet printer.

18. A scanning inkjet printing system, comprising:

a first printhead for printing a printing fluid, the first printhead comprising a first array of nozzles;

a second printhead for printing with a treatment fluid, the second printhead comprising a second array of nozzles, wherein the first and second printhead interfaces are positioned on a carriage arranged to scan across a print zone in a direction perpendicular to a print media advance direction; and a print controller to logically offset a bottom-most useable nozzle of the array of nozzles in one of the first and second printheads to be a nozzle other than the bottom-most nozzle in the first or second array to compensate for a misalignment between the bottom-most nozzle in the first printhead and the bottom-most nozzle in the second printhead and cause a bottom-most useable nozzle in the first array to be aligned with a bottom-most useable nozzle in the second array in a direction perpendicular to the direction of relative movement, wherein the nozzles in the first array of nozzles extend a first distance in the print media advance direction and the nozzles in the second array of nozzles extend a second distance in the print media advance direction, wherein the second distance is greater than the first distance.

* * * * *